United States Patent [19]

Woo

[11] Patent Number: 5,036,829

[45] Date of Patent: Aug. 6, 1991

[54] HEATING APPARATUS

[76] Inventor: Chi G. Woo, 2119 Potspring Rd., Lutherville, Md. 21093

[21] Appl. No.: 650,944

[22] Filed: Feb. 5, 1991

Related U.S. Application Data

[63] Continuation-in-part of Ser. No. 520,747, May 9, 1990, abandoned.

[51] Int. Cl.[5] ..... F24F 3/14

[52] U.S. Cl. ..... 126/113; 126/53; 126/101; 126/114; 126/116 A; 122/14

[58] Field of Search ..... 126/101, 113, 99 R, 126/116 R, 110 E, 116 A, 114, 5, 55, 54, 34, 35; 122/14, 15, 20 B, 33; 165/DIG. 2, 163, 122

[56] References Cited

U.S. PATENT DOCUMENTS 2,080,949 5/1937 McCombs et al. ..... 126/101
3,277,275 10/1966 Brusven ..... 126/101
4,090,492 5/1978 Simmons ..... 126/101
4,700,686 10/1987 Woo ..... 126/113
4,767,262 8/1988 Simon ..... 165/122

*Primary Examiner*—James C. Yeung
*Attorney, Agent, or Firm*—Birch, Stewart, Kolasch & Birch

[57] ABSTRACT

A heating which comprises a housing containing a water conduit, a fire compartment for heating the water in the water conduit, a heating chamber containing a plurality of heat emitting fin coil members disposed therein, a water storage tank disposed on the housing, and four turbo fans for blowing hot air around the plurality of heat emitting fin coil member and circulating the heated air into the room, whereby the heating apparatus produces hot air with a controlled humidity while at the same time reducing fire danger and pollution due to dust, smoke, and ash.

4 Claims, 1 Drawing Sheet

HEATING APPARATUS

CROSS REFERENCE TO RELATED APPLICATION

This is a continuation-in-part application of U.S. patent application Ser. No. 07/520,747, filed on May 9, 1990, now abandoned.

BACKGROUND OF THE INVENTION

1. Field of the Invention

The present invention relates to a heating apparatus for use indoors, especially for use in a hall, an office, a room of a house, and the like. More particularly, the present invention relates to a heating apparatus which comprises a housing, a water conduit, a fireplace compartment for heating the water disposed within the water conduit, a fin coil member, and a blowing system for circulating hot air from the fireplace compartment through the water and to the fin coil member for heating the building and house while reducing many problems associated with fire danger.

2. Description of the Prior Art

Many types of heating apparatus used indoors are well known in the art. Usually, a fin coil heating apparatus utilized an electric source and a fireplace located in the wall of a house ar used as a source of heat in cold weather. However, it is very difficult to recover the heat from the fireplace when burning materials such as wood or kerosene. Furthermore, there always exists danger of fire and the mess produced by dust and ash generated from the fireplace. Also, such fin coil heating apparatus include a plurality of heat emitting members heated by an electric source and a propeller fan for blowing air across the heat emitting members to heat an air and discharge it to the room environment. However, it is very noisy while the fan is actuated and the hot air to be delivered to the room from heat emitting members is very dry. Thus, there are many problems associated with prior art fireplaces and indoor heating apparatus.

SUMMARY OF THE INVENTION

Accordingly, it is an object of the present invention to provide an improved heating apparatus.

Another object of the present invention is to provide a heating apparatus, particularly one which can be positioned in a room of a house, a hall, an office, and the like.

A further object of the present invention is to provide a heating apparatus comprising a water storage tank, a fireplace compartment for heating the water, a fin coil member for heat emitting and four turbo fans for circulating the hot air emitted from the plurality of fin coil member to the room for reducing noise pollution when compared with a propeller fan of a conventional heating apparatus.

Still another object of the present invention is to provide a heating apparatus which contains a water storage tank disposed on a housing containing a water conduit for supplying water to the water conduit as well as maintaining the humidity of the environment.

A further object of the present invention is to provide a heating apparatus which is structured with a fireplace compartment provided with a burner for burning liquid fuel.

Yet another object of the present invention is to provide a heating apparatus which includes a plurality of fans for reducing the noise thereof.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a heating which comprises a housing containing a water conduit, a fire compartment for heating the water in the water conduit, a heating chamber containing a plurality of heat emitting fin coil members disposed therein, a water storage tank disposed on the housing, and four turbo fans for blowing hot air around the plurality of heat emitting fin coil member and circulating the heated air into the room, whereby the heating apparatus produces hot air with a controlled humidity while at the same time reducing fire danger and pollution due to dust, smoke, and ash.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 2:
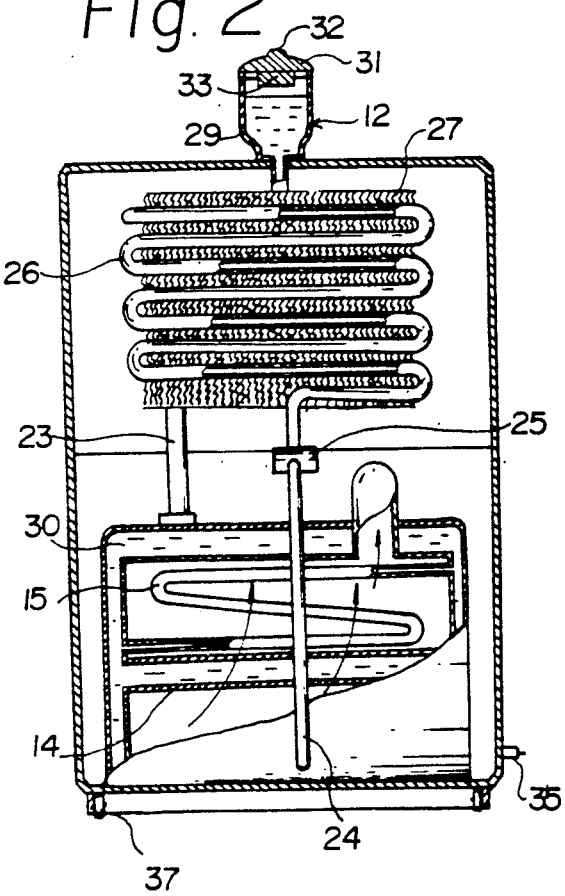
FIG. 2 is a cross-sectional view of FIG. 1, taken along lines 2—2.
Figure 3:
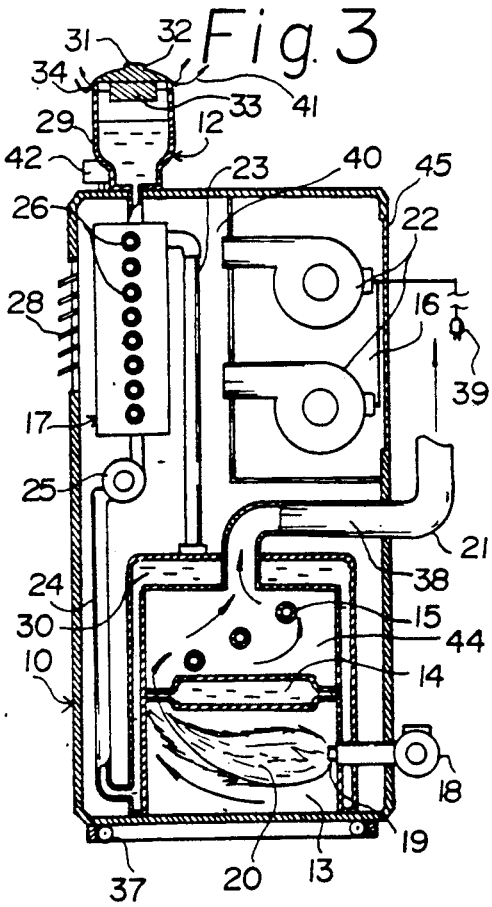
FIG. 3 is a cross-sectional view of FIG. 1, taken along line 3—3.

Referring now in detail to the drawings for the purpose of illustrating preferred embodiments of the present invention, the heating apparatus as shown in FIGS. 2, and 3, comprises a housing 10, a front door 11 disposed in the upper portion of the front side wall of the housing 10, a water storage tank 12 disposed on the top of the housing 10 and a chimney 21 disposed in the middle portion of the rear side wall of the housing 10.

The housing 10 includes a water main conduit 14 and a water auxiliary conduit 15 adapted to contain water 30, a fireplace compartment 13 provided with a burner 18 disposed under the water conduit 14, a fuel injection nozzles 19 attached to the burner 18, and a heat chamber 44 communicated with the fireplace compartment 13 and connected to the chimney 21. The auxiliary conduit 15 have a serpentine configuration.

Also, the housing 10 further includes a heat emitting fin coil member 17 disposed in the upper portion of the housing 10 and containing a plurality of water pipes 26 having a plurality of fin coils 27, and a fan housing 16 disposed in the upper portion of the housing 10 for containing at least two pairs of turbo fans 22 and a plurality of air inlet apertures 45. The water 30 in the main and auxiliary water conduits 14 and 15 is delivered to the plurality of water pipes 26 through an upward pipe 23. At this time, the plurality of fin coils 27 are heated by the hot water circulating in the conduits 14 and 15 since the cold water in the plurality of serpentine configured water pipes 26 is discharged to the main water conduit 15 by a pump 25 through downward pipe 24.

The plurality of turbo fans 22, preferably four turbo fans 22, inserted in the fan housing 16 and connected to an electric plug 39 blows air through a chamber 40 in indirect heat exchange with exhaust gas passing through a gas conduit 38 into the fin coil member 17. Thus, the heat air and heat air from the plurality of fin coils 27 and plurality of water pipes 26 is blown by the four turbo fans 22 to the outside of the heating apparatus through a plurality of louvers 28. The louvers 28 control the direction of the heat air in any desired direction.

Figure 1:
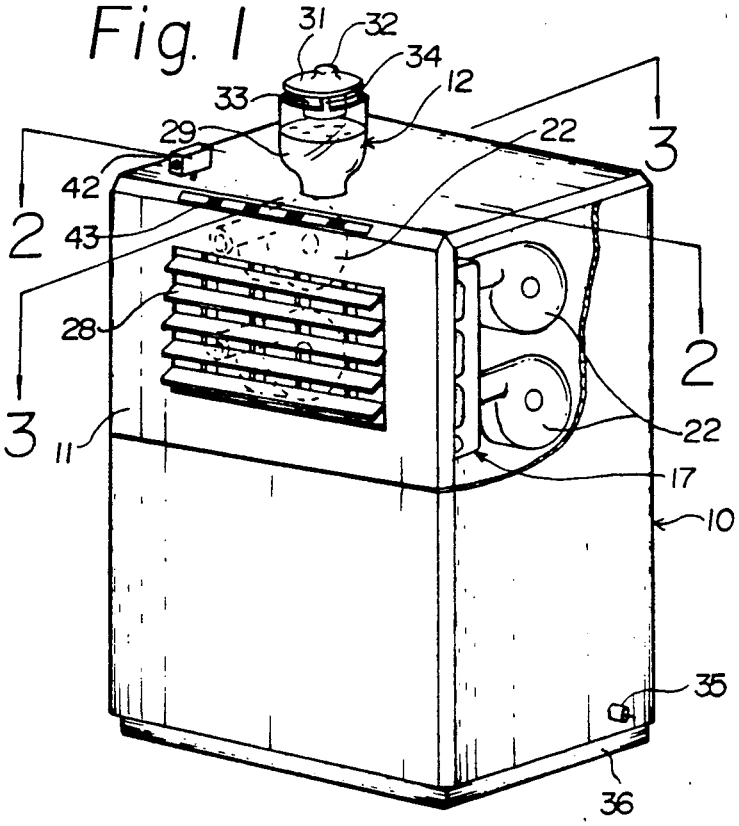
FIG. 1 is a perspective view of the heating apparatus of the present invention containing cut-away portions in order to show four turbo fans of the heating apparatus of the present invention.

The water storage tank 12 comprises a bottle 29 which communicates with the water main conduit 14 through the upward pipe 23 and the downward pipe 24, and a cap 31 having a handle 32. The water storage tank 12 further comprises an extension member 33 and a plurality of raised portions 34 for providing a space between the bottle 29 and the cap 31 to permit steam 41 to escape (FIG. 1). Thus, the steam 41 from the water storage tank 12 can maintain the humidity in the room. When necessary, the water 30 can be supplied through the top of storage tank 12. Also, since the open water storage tank 12 communicates with the water main and auxiliary conduits 14 and 15, the water main and auxiliary conduits 14 and 15 are prevented from exploding due to the accumulation of excess temperature or pressure in the water conduits 14 and 15.

A controller 42 and a controlling panel 43 are disposed at the front portion in the top wall of the housing 10. The controller 19 controls the temperature in the water conduits 14 and 15 and actuates the four turbo fans 22 disposed in the fan housing 16 at a predetermined indoor temperature of the fin coil member 17. Also, an on/off switch is disposed on the control panel 43 to actuate the burner 18 mounted to the front side wall of the housing 10.

The housing 10 is supported a base member optionally having a plurality of rollers (not shown). A drainage pipe 35 disposed on the lower portion of the side wall of the housing 10 is drained water 30 in the conduits 14 and 15 therethrough.

In operation, after the water conduit 14 is filled with water 30 as shown in FIGS. 2 and 3, and the on/off switch disposed at the control panel 43 is actuated to ignite the injection nozzles 19 of the burner 18.

The fire 20 from the burner 18 heats the water 30 in the water main conduit 14 and the serpentine configured auxiliary conduit 15 disposed the heat chamber 44.

And the plurality of water main and auxiliary conduits 14 and 15 are heated by the fire 20. At this time, the hot water 30 is circulated by the pump 25 from the conduits 14 and 15 to the plurality of fin coil pipes 26 through the upward pipe 23 simultaneously, the four turbo fans 22 disposed in fan housing 16 is actuated to blow air from the plurality of air inlet apertures 45. Accordingly, the hot air around the fin coil member 17 is blown out. The hot air is thus transferred to the room environment. The temperature in the indoors can be automatically controlled by the controller 42. By actuating the on/off switch disposed at the controlling panel 43, the burner 18 can be continued or discontinued as necessary, to burn. Also, the water storage tank 12 is provided with space so that it can prevent the heating apparatus from exploding and add humidity to the room, the office, or the like during the operation of the heating apparatus.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A heating apparatus comprising:

a housing, means for introducing water to a plurality of water conduits of said housing, said means for introducing water including a water bottle which is vented to the atmosphere to add humidity to the room environment and to provide a safety relief valve for excess temperature and pressure, said water conduits defining a main conduit and a serpentine configured auxiliary water conduit, a fireplace compartment disposed within said housing, said fireplace compartment being provided with a burner, a fin coil member disposed in the upper portion of said housing and communicating with the room environment for heat emitting, said fin coil member containing a serpentine configured fin coils disposed therein for absorbing heat from the water disposed in the water conduits, a heat chamber containing said water conduits, said heat chamber connected at one end to said fireplace compartment and at the other end to a chimney disposed at the middle of the said fireplace compartment for circulating hot combustion gases therethrough and for heating the water disposed in the water conduits, said combustion gases being vented from said chimney, and at least four turbo fans communicating with said heat chamber for blowing air across said fin coil member so as to heat said air and discharge it to the room environment, and reduce noise pollution of the heating apparatus.

2. The heating apparatus of claim 1, wherein the air from the turbo fans is in heat exchange relationship with the heat chamber carrying the exhaust gas.

3. The heating apparatus of claim 1, wherein the fireplace compartment disposed under the water conduits.

4. The heating apparatus of claim 1, a serpentine configured pipe of the fin coil member is communicated the main water conduit at one end thereof and the other end thereof through a pump.

* * * * *